US010134322B2

(12) United States Patent
Chang

(10) Patent No.: US 10,134,322 B2
(45) Date of Patent: Nov. 20, 2018

(54) PIXEL STRUCTURE AND DISPLAY METHOD

(71) Applicant: AU OPTRONICS CORPORATION, Hsin-chu (TW)

(72) Inventor: Yi-Wen Chang, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/589,374

(22) Filed: May 8, 2017

(65) Prior Publication Data

US 2017/0337863 A1 Nov. 23, 2017

(30) Foreign Application Priority Data

May 20, 2016 (TW) ..... 105115753 A

(51) Int. Cl.
*G09G 3/20* (2006.01)
*G09G 3/3225* (2016.01)

(52) U.S. Cl.
CPC ..... *G09G 3/2003* (2013.01); *G09G 3/3225* (2013.01); *G09G 3/20* (2013.01); *G09G 2300/0452* (2013.01); *G09G 2340/10* (2013.01); *G09G 2358/00* (2013.01)

(58) Field of Classification Search
None
See application file for complete search history.

(56) References Cited

U.S. PATENT DOCUMENTS 8,144,138 B2 3/2012 Kim et al.
2009/0243971 A1 10/2009 Uehara
2011/0018860 A1 1/2011 Parry-Jones et al.
2011/0122329 A1 5/2011 Broughton et al.
2011/0175936 A1 7/2011 Smith et al.
(Continued)

FOREIGN PATENT DOCUMENTS

CN 102620149 A 8/2012
CN 105185266 A 12/2015
(Continued)

OTHER PUBLICATIONS

European Search Report issued by the European Patent Office (EPO) dated Jul. 19, 2017 for EP17171785.3.
(Continued)

*Primary Examiner* — Mark Zimmerman
*Assistant Examiner* — Yu-Jang Tswei
(74) *Attorney, Agent, or Firm* — Locke Lord LLP; Tim Tingkang Xia, Esq.

(57) ABSTRACT

A pixel structure, including a first color pixel, a second color pixel and a third color pixel. The first color pixel includes a first-color normal-viewing sub-pixel and at least one first-color side-viewing sub-pixel. The second color pixel includes a second-color normal-viewing sub-pixel and at least one second-color side-viewing sub-pixel. The third color pixel includes a third-color normal-viewing sub-pixel and at least one third-color side-viewing sub-pixel. First color light emitted from the first-color normal-viewing sub-pixel, second color light emitted from the second-color side-viewing sub-pixel, and third color light emitted from the third-color side-viewing sub-pixel are mixed to obtain a white emission in a first side view direction.

13 Claims, 7 Drawing Sheets

(56) References Cited

U.S. PATENT DOCUMENTS

| | | | | |
|---|---|---|---|---|
| 2011/0221655 | A1* | 9/2011 | Fukui | G09G 3/001 345/4 |
| 2012/0313844 | A1 | 12/2012 | Im et al. | |
| 2015/0221710 | A1* | 8/2015 | Motoyama | H01L 27/3218 257/89 |
| 2015/0286097 | A1* | 10/2015 | Lee | G02F 1/133617 349/61 |
| 2016/0329385 | A1 | 11/2016 | Qiu et al. | |
| 2017/0018254 | A1 | 1/2017 | Chang et al. | |
| 2017/0329150 | A1* | 11/2017 | Mukhtarov | G02B 27/2242 |

FOREIGN PATENT DOCUMENTS

| | | | |
|---|---|---|---|
| CN | 105487268 | A | 4/2016 |
| CN | 103491290 | B | 9/2016 |
| JP | 2010169911 | A | 8/2010 |

OTHER PUBLICATIONS

Office Action issued by (TIPO) Intellectual Property Office, Ministry of Economic Affairs, R. 0. C. dated Oct. 14, 2016 or Application No. 105115753, Taiwan.

* cited by examiner

PIXEL STRUCTURE AND DISPLAY METHOD

CROSS-REFERENCE TO RELATED PATENT APPLICATION

This application claims the benefit of priority to Taiwan Patent Application No. 105115753, filed May 20, 2016. The entire content of the above identified application is incorporated herein by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present invention relates to a display technology, and in particular, to a pixel structure and a display method.

BACKGROUND

Recently, with the development and popularity of display technologies, display devices have been applied to various types of electronic devices, such as personal desktop computers, tablet computers, or other portable electronic devices.

However, in many circumstances, a user does not want content displayed on a display device of an electronic device to be peeped by others. Therefore, a problem that needs to be solved in the field exists in how an anti-peeping capability of a display device may be improved.

SUMMARY

In view of the above, the context of this disclosure provides a pixel structure and a display method, so as to solve the problem in the prior art.

An embodiment of this disclosure relates to a pixel structure. The pixel structure includes a first color pixel, a second color pixel, and a third color pixel. The first color pixel includes a first-color normal-viewing sub-pixel and at least one first-color side-viewing sub-pixel. The second color pixel includes a second-color normal-viewing sub-pixel and at least one second-color side-viewing sub-pixel. The third color pixel includes a third-color normal-viewing sub-pixel and at least one third-color side-viewing sub-pixel. First color light emitted from the first-color normal-viewing sub-pixel, second color light emitted from the second-color side-viewing sub-pixel, and third color light emitted from the third-color side-viewing sub-pixel are mixed to obtain a white emission in a first side view direction.

An embodiment of this disclosure relates to a display method. A first-color normal-viewing sub-pixel, at least one second-color side-viewing sub-pixel, and at least one third-color side-viewing sub-pixel in a pixel structure are driven, so as to enable the first-color normal-viewing sub-pixel, the at least one second-color side-viewing sub-pixel, and the at least one third-color side-viewing sub-pixel to respectively emit first color light, second color light, and third color light.

The first color light, the second color light, and the third color light are mixed to obtain a white emission in a first side view direction.

To sum up, by using one of the aforementioned embodiments, an anti-peeping capability of a display device can be improved.

BRIEF DESCRIPTION OF THE DRAWINGS

To make the foregoing and other objectives, features, advantages, and embodiments of this disclosure more comprehensible, accompanying drawings are described as follows.

DETAILED DESCRIPTION

Embodiments are described in detail below with the accompanying drawings, but the provided embodiments are not intended to limit the scope of this disclosure. The description of a structural operation is not intended to limit the implementation order of the structural operation. Any device with equivalent functions that is generated by a structure recombined by elements shall fall within the scope of this disclosure. In addition, the accompanying drawings are merely used for illustration and are not drawn to scale. To facilitate the comprehension, a same element or like elements in the following description is described by using a same reference sign.

The terms used in this specification and the claims generally have their ordinary meanings in the art, in the context of this disclosure, and in specific contexts unless the terms are additionally annotated.

The terms such as "first", "second" and "third" used in this specification are not intended to indicate sequences or orders and are not intended to limit this disclosure, and are merely intended to distinguish between elements or operations described by using a same technical term.

Figure 1A:
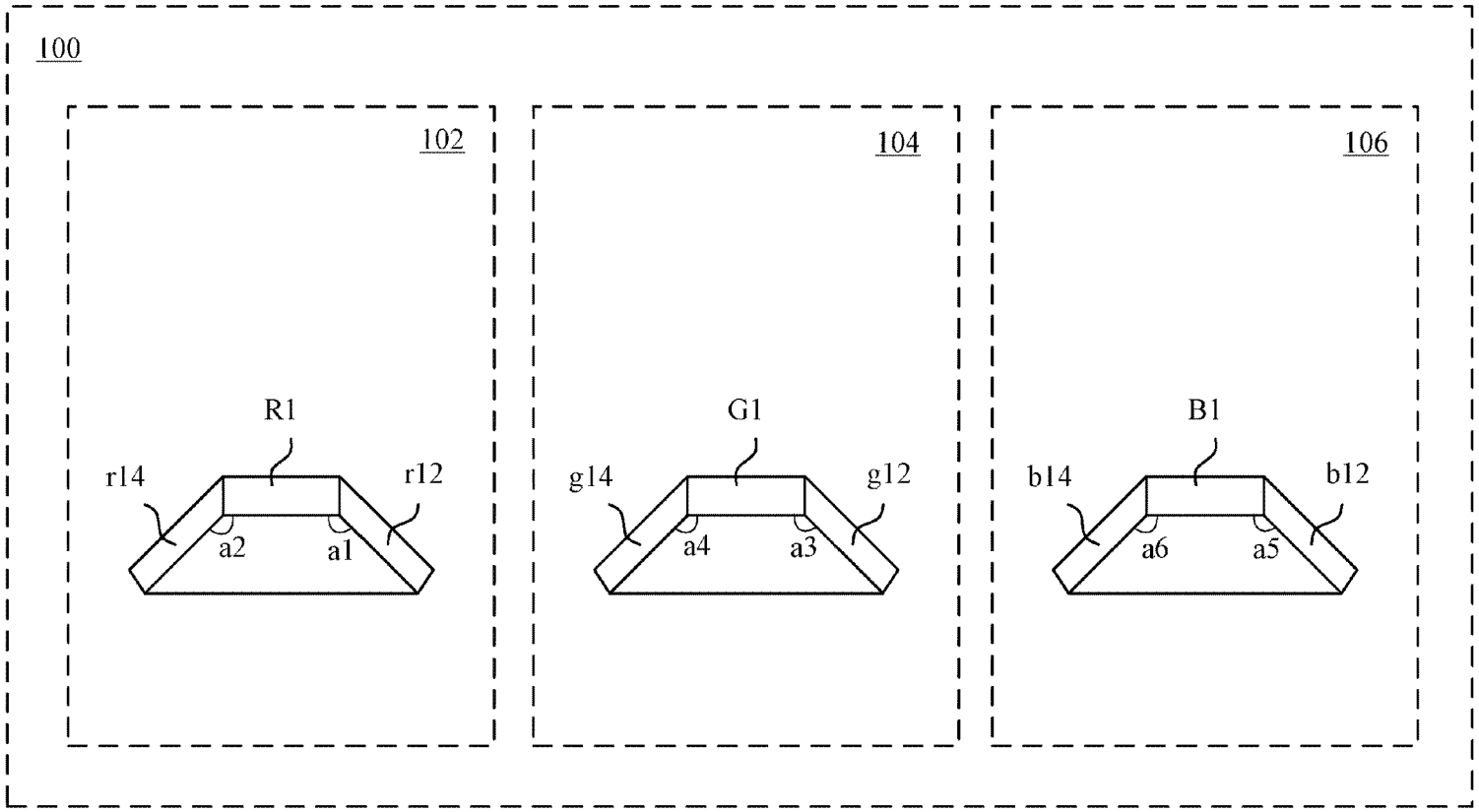
FIG. 1A is a schematic diagram of a pixel structure drawn according to some embodiments of this disclosure.

FIG. 1A is a schematic diagram of a pixel structure 100 drawn according to some embodiments of this disclosure. A plurality of pixel structures 100 is included in a display device. Using FIG. 1A as an example, the pixel structure 100 includes a first color pixel 102, a second color pixel 104, and a third color pixel 106. The first color pixel 102 is configured to emit first color light. The second color pixel 104 is configured to emit second color light. The third color pixel 106 is configured to emit third color light. In some embodiments, the first color is red, the second color is green, and the third color is blue. However, this disclosure is not limited thereto.

In some embodiments, the first color pixel 102, the second color pixel 104, and the third color pixel 106 are implemented by using organic light emitting diodes (OLEDs).

In some embodiments, the first color pixel 102, the second color pixel 104, and the third color pixel 106 are with different areas. The pixel size of the third color pixel 106 is larger than that of the second color pixel 104 and the pixel size of the second color pixel 104 is larger than that of the first color pixel 102. Moreover, in certain embodiments, area of the first-color normal-viewing sub-pixel R1: area of the second-color normal-viewing sub-pixel G1: area of the third-color normal-viewing sub-pixel B1=area of the first-color left-side-viewing sub-pixel r14: area of the second-color left-side-viewing sub-pixel g14: area of the third-color left-side-viewing sub-pixel b14=area of the first-color right-side-viewing sub-pixel r12: are of the second-color right-side-viewing sub-pixel g12: area of the third-color right-side-viewing sub-pixel b12.

The sizes of the first color pixel, the second color pixel and the third color pixel may be different. In certain embodiments, the first color pixel, the second color pixel and the third color pixel have the same size but the numbers of the first color pixel, the second color pixel and the third color pixel are different. In some embodiments, the number of the first color pixel 102 is smaller than the number of the second color pixel 104 and the number of the second color pixel 104 is smaller than the number of the third color pixel 106.

The first color pixel 102 includes a first-color normal-viewing sub-pixel R1 and at least one first-color side-viewing sub-pixel. Using FIG. 1A as an example, the first-color side-viewing sub-pixel includes a first-color right-side-viewing sub-pixel r12 and a first-color left-side-viewing sub-pixel r14. The first-color right-side-viewing sub-pixel r12 and the first-color left-side-viewing sub-pixel r14 are separately disposed at two sides of the first-color normal-viewing sub-pixel R1, and separately have an oblique angle a1 and an oblique angle a2 with the first-color normal-viewing sub-pixel R1.

The second color pixel 104 includes a second-color normal-viewing sub-pixel G1 and at least one second-color side-viewing sub-pixel. Using FIG. 1A as an example, the second-color side-viewing sub-pixel includes a second-color right-side-viewing sub-pixel g12 and a second-color left-side-viewing sub-pixel g14. The second-color right-side-viewing sub-pixel g12 and the second-color left-side-viewing sub-pixel g14 are separately disposed at two sides of the second-color normal-viewing sub-pixel G1, and separately have an oblique angle a3 and an oblique angle a4 with the second-color normal-viewing sub-pixel G1.

The third color pixel 106 includes a third-color normal-viewing sub-pixel B1 and at least one third-color side-viewing sub-pixel. Using FIG. 1A as an example, the third-color side-viewing sub-pixel includes a third-color right-side-viewing sub-pixel b12 and a third-color left-side-viewing sub-pixel b14. The third-color right-side-viewing sub-pixel b12 and the third-color left-side-viewing sub-pixel b14 are separately disposed at two sides of the third-color normal-viewing sub-pixel B1, and separately have an oblique angle a5 and an oblique angle a6 with the third-color normal-viewing sub-pixel B1.

In some embodiments, the foregoing sub-pixels may be separately driven by different drive transistors. That is, the sub-pixels can be independently driven. In some other embodiments, the normal-viewing sub-pixels are separately driven by different drive transistors, and side-viewing sub-pixels of a same color are driven by a same driven transistor. For example, the first-color normal-viewing sub-pixel R1, the second-color normal-viewing sub-pixel G1, and the third-color normal-viewing sub-pixel B1 are separately driven by three drive transistors. The first-color right-side-viewing sub-pixel r12 and the first-color left-side-viewing sub-pixel r14 are driven by a same drive transistor. The second-color right-side-viewing sub-pixel g12 and the second-color left-side-viewing sub-pixel g14 are driven by a same drive transistor. The third-color right-side-viewing sub-pixel b12 and the third-color left-side-viewing sub-pixel b14 are driven by a same drive transistor.

Further, in some embodiments, light emitted by the foregoing sub-pixels are in Lambertian distribution, Gauss distribution and so on.

Figure 1B:
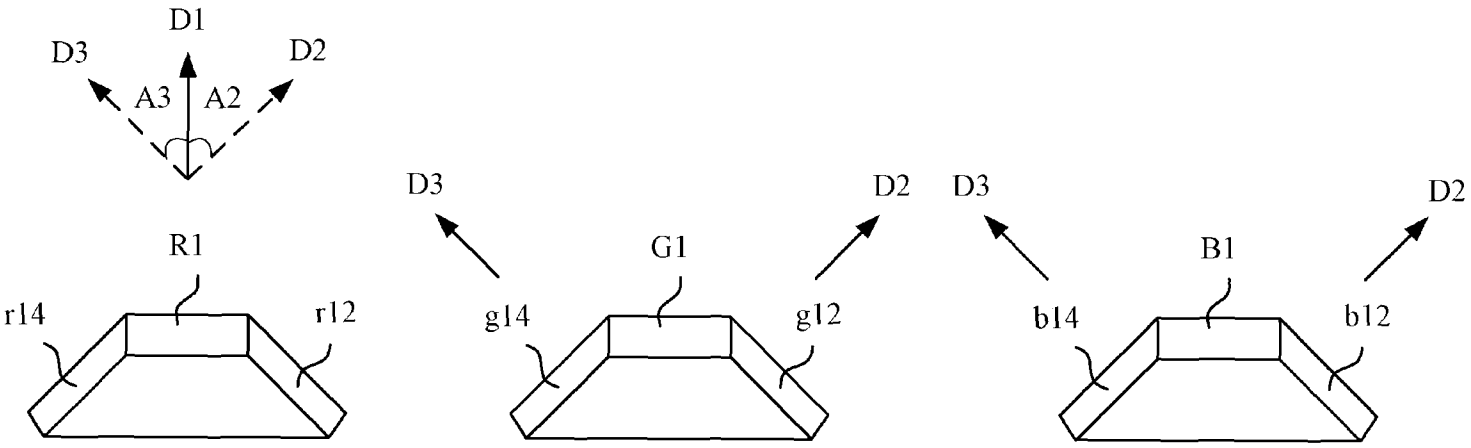
FIG. 1B is a schematic diagram of the pixel structure of FIG. 1A with a normal view direction and side view directions.

FIG. 1B is a schematic diagram of the pixel structure 100 of FIG. 1A with a normal view direction D1 and side view directions D2 and D3. Referring to FIG. 1B, it is assumed that the pixel structure 100 intends to use the first-color normal-viewing sub-pixel R1 to display red image information, and the normal view direction D1 of the first-color normal-viewing sub-pixel R1 is defined as 0°. In certain embodiments, the normal view direction D1 is substantially perpendicular to the surface of the first-color normal viewing sub-pixels. Moreover, each of the foregoing "normal-viewing" sub-pixels means that a maximum brightness value of light emitted by the sub-pixel is not greater than 5°. Moreover, each of the foregoing "side-viewing" sub-pixels means that a maximum brightness value of light emitted by the sub-pixel is greater than 5°.

A light emergent direction of each of the normal-viewing sub-pixels is towards the normal view direction D1. In some embodiments, an intensity of emergent light in a normal view direction of a normal-viewing sub-pixel is greater than an intensity of emergent light in a side view direction. A light emergent direction of each of the side-viewing sub-pixels is towards a right-side direction or a left-side direction. In some embodiments, an intensity of emergent light in a side view direction of a side-viewing sub-pixel is greater than an intensity of emergent light in a normal view direction. A right-side direction is not parallel to the normal view direction D1. A left-side direction is not parallel to the normal view direction D1. In other words, a light emergent direction of each of the normal-viewing sub-pixels is not the same as and is not parallel to a light emergent direction of each of the side-viewing sub-pixels.

It is assumed that red light emitted by the first-color normal-viewing sub-pixel R1 has a maximum brightness value in the normal view direction D1. It is assumed that green light emitted by the second-color right-side-viewing sub-pixel g12 has a maximum brightness value in a side view direction D2. It is assumed that green light emitted by the second-color left-side-viewing sub-pixel g14 has a maximum brightness value in a side view direction D3. It is assumed that blue light emitted by the third-color right-side-viewing sub-pixel b12 has a maximum brightness value in the side view direction D2. It is assumed that blue light emitted by the second-color right-side-viewing sub-pixel b14 has a maximum brightness value in the side view direction D3. The above assumptions are intended to facilitate the understanding, and are not intended to limit the context of this disclosure.

In this case, a user can clearly view, in the normal view direction D1, the red light emitted by the first-color normal-viewing sub-pixel R1. However, the red light emitted by the first-color normal-viewing sub-pixel R1 is in Lambertian distribution, but is not limited thereto. Therefore, the normal view direction D1 is not the only direction in which the red light emitted by the first-color normal-viewing sub-pixel R1 appears. That is, when only the first-color normal-viewing sub-pixel R1 is driven, the user can view the red light emitted by the first-color normal-viewing sub-pixel R1 in the normal view direction D1 and other directions. For example, the user may view the red light emitted by the first-color normal-viewing sub-pixel R1 in the side view direction D2, the side view direction D3, or other directions.

In order to improve an anti-peeping capability of a display device, the red light in directions other than the normal view direction D1 needs to be cancelled, filtered or whitening. Therefore, if the pixel structure 100 intends to display red image information in the normal view direction, the first-color normal-viewing sub-pixel R1, the second-color right-side-viewing sub-pixel g12, the second-color left-side-viewing sub-pixel g14, the third-color right-side-viewing sub-pixel b12, and the third-color left-side-viewing sub-pixel b14 are to be driven synchronously. The brightness from the first-color normal-viewing sub-pixel R1, the second-color right-side-viewing sub-pixel g12 and the second-color left-side-viewing sub-pixel g14 in the direction D2 is not the same, the brightness is less than ½ of the brightness from the first-color normal-viewing sub-pixel R1, the second-color right-side-viewing sub-pixel g12 and the second-color left-side-viewing sub-pixel g14 in the direction D1, and/or the final mixing light is in the color coordinate of (0.313+/−0.06, 0.329+/−0.06) By means of the foregoing manner, it is assumed that the user views the pixel structure 100 from the side view direction D2. The red light that is emitted by the first-color normal-viewing sub-pixel R1 and is in the side view direction D2, green light that is emitted by the second-color right-side-viewing sub-pixel g12 and is the side view direction D2, and blue light that is emitted by the third-color right-side-viewing sub-pixel b12 and is in the side view direction D2 are mixed to obtain a white emission. In this way, if the user views the pixel structure 100 from the side view direction D2, the user does not view the red image information displayed by the first-color normal-viewing sub-pixel R1, thereby achieving an anti-peeping objective.

Similarly, it is assumed that the user views the pixel structure 100 from the side view direction D3. The red light that is emitted by the first-color normal-viewing sub-pixel R1 and is in the side view direction D3, green light that is emitted by the second-color left-side-viewing sub-pixel g14 and is the side view direction D3, and blue light that is emitted by the third-color left-side-viewing sub-pixel b14 and is in the side view direction D3 are mixed to obtain a white emission. In this way, if the user views the pixel structure 100 from the side view direction D3, the user does not view the red image information displayed by the first-color normal-viewing sub-pixel R1, thereby achieving an anti-peeping objective.

A side viewing angle A2 is formed between the side view direction D2 and the normal view direction D1, and a side viewing angle A3 is formed between the side view direction D3 and the normal view direction D1. It should be particularly noted that the side view direction D2 or the side view direction D3 drawn in the figures is merely used for illustration. The side view direction in this disclosure is not limited to the side view direction D2 or the side view direction D3. That is, an angle of the side viewing angle A2 and an angle of the side viewing angle A3 are not limited to the angles in the figures. In some embodiments, the angle of the side viewing angle A2 (or the side viewing angle A3) is within a range between 10° and 80°.

Further, referring to FIG. 1A again, angles of the oblique angles a1-a6 are merely used for illustration. The angles of the oblique angles a1-a6 are designed according to practical applications. For example, the oblique angles a3-a6 are designed according to light field distribution of the first-color normal-viewing sub-pixel R1. In some embodiments, the oblique angles a1-a6 may be greater than 90°.

Figure 2:
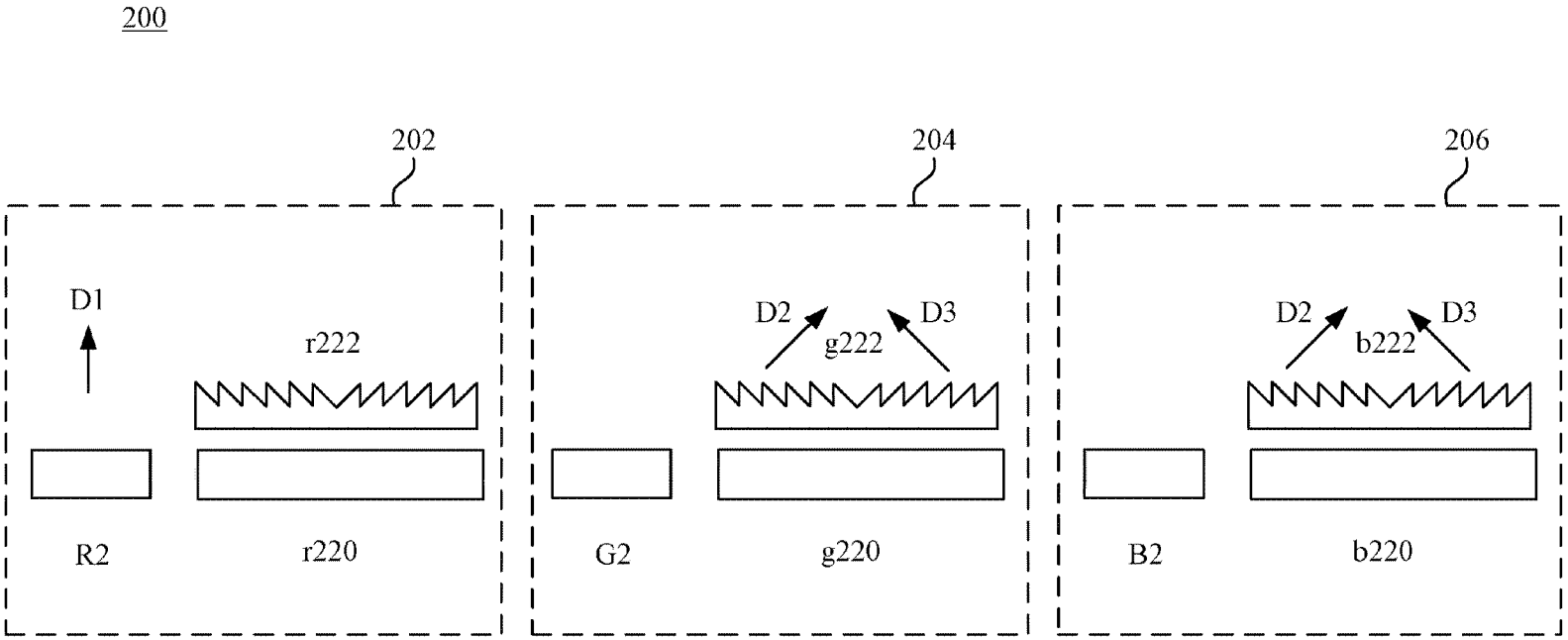
FIG. 2 is a schematic diagram of a pixel structure drawn according to some embodiments of this disclosure.

FIG. 2 is a schematic diagram of a pixel structure 200 drawn according to some embodiments of this disclosure. Using FIG. 2 as an example, the pixel structure 200 includes a first color pixel 202, a second color pixel 204, and a third color pixel 206. The first color pixel 202 is configured to emit first color light. The second color pixel 204 is configured to emit second color light. The third color pixel 206 is configured to emit third color light.

The first color pixel 202 includes a first-color normal-viewing sub-pixel R2 and at least one first-color side-viewing sub-pixel. Using FIG. 2 as an example, the first-color side-viewing sub-pixel includes a first-color side-viewing sub-pixel unit r220 and a first-color side-viewing prism r222. The second color pixel 204 includes a second-color normal-viewing sub-pixel G2 and at least one second-color side-viewing sub-pixel. Using FIG. 2 as an example, the second-color side-viewing sub-pixel includes a second-color side-viewing sub-pixel unit g220 and a second-color side-viewing prism g222. The third color pixel 206 includes a third-color normal-viewing sub-pixel B2 and at least one third-color side-viewing sub-pixel. Using FIG. 2 as an example, the third-color side-viewing sub-pixel includes a third-color side-viewing sub-pixel unit b220 and a third-color side-viewing prism b222.

In some embodiments, the first-color normal-viewing sub-pixel R2, the second-color normal-viewing sub-pixel G2, the third-color normal-viewing sub-pixel B2, the first-color side-viewing sub-pixel unit r220, the second-color side-viewing sub-pixel unit g220, and the third-color side-viewing sub-pixel unit b220 are implemented by using OLEDs.

In some embodiments, the first-color normal-viewing sub-pixel R2, the second-color normal-viewing sub-pixel G2, the third-color normal-viewing sub-pixel B2, the first-color side-viewing sub-pixel unit r220, the second-color side-viewing sub-pixel unit g220, and the third-color side-viewing sub-pixel unit b220 are separately driven by different drive transistors.

The second-color side-viewing sub-pixel unit g220 emits green light at least in a side view direction D2 and a side view direction D3 by the second-color side-viewing prism g222. Specifically, the green light emitted by the second-color side-viewing sub-pixel unit g220 is emitted at least towards the side view direction D2 by a left half part of the second-color side-viewing prism g222, and the green light emitted by the second-color side-viewing sub-pixel unit g220 is emitted at least towards the side view direction D3 by a right half part of the second-color side-viewing prism g222. In some embodiments, the green light emitted by the second-color side-viewing sub-pixel unit g220 is emitted at least towards the side view direction D2 by the right half part of the second-color side-viewing prism g222, and the green light emitted by the second-color side-viewing sub-pixel unit g220 is emitted at least towards the side view direction D3 by the left half part of the second-color side-viewing prism g222.

The third-color side-viewing sub-pixel unit b220 emits blue light at least in the side view direction D2 and the side view direction D3 by the third-color side-viewing prism b222. Specifically, the blue light emitted by the third-color side-viewing sub-pixel unit b220 is emitted at least towards the side view direction D2 by a left half part of the third-color side-viewing prism b222, and the blue light emitted by the third-color side-viewing sub-pixel unit b220 is emitted at least towards the side view direction D3 by a right half part of the third-color side-viewing prism b222. In some embodiments, the blue light emitted by the third-color side-viewing sub-pixel unit b220 is emitted at least towards the side view direction D2 by the right half part of the third-color side-viewing prism b222, and the blue light emitted by the third-color side-viewing sub-pixel unit b220 is emitted at least towards the side view direction D3 by the left half part of the third-color side-viewing prism b222.

It should be particularly noted that the light emitted by the sub-pixels is in Lambertian distribution, and therefore, the light emitted by each of the prisms is not emitted towards a single direction. However, for the purpose of facilitating the understanding, the side view direction D2 and the side view direction D3 are used as examples in the figure.

In order to improve an anti-peeping capability of a display device, the red light in directions other than the normal view direction D1 needs to be cancelled or filtered. If the pixel structure 200 intends to display red image information in the normal view direction only, the first-color normal-viewing sub-pixel R2, the second-color side-viewing sub-pixel unit g220, and the third-color side-viewing sub-pixel unit b220 are to be driven synchronously.

By means of the foregoing manner, the red light that is emitted by the first-color normal-viewing sub-pixel R1 and is in the side view direction D2, green light that is emitted by the second-color side-viewing sub-pixel unit g220 and is the side view direction D2, and blue light that is emitted by the third-color side-viewing sub-pixel unit b220 and is in the side view direction D2 are mixed to obtain a white emission. In this way, if a user views the pixel structure 200 from the side view direction D2, the user does not view the red image information displayed by the first-color normal-viewing sub-pixel R1, thereby achieving an anti-peeping objective. The part related to the side view direction D3 has similar content, and therefore, description is not made herein again.

Figure 3:
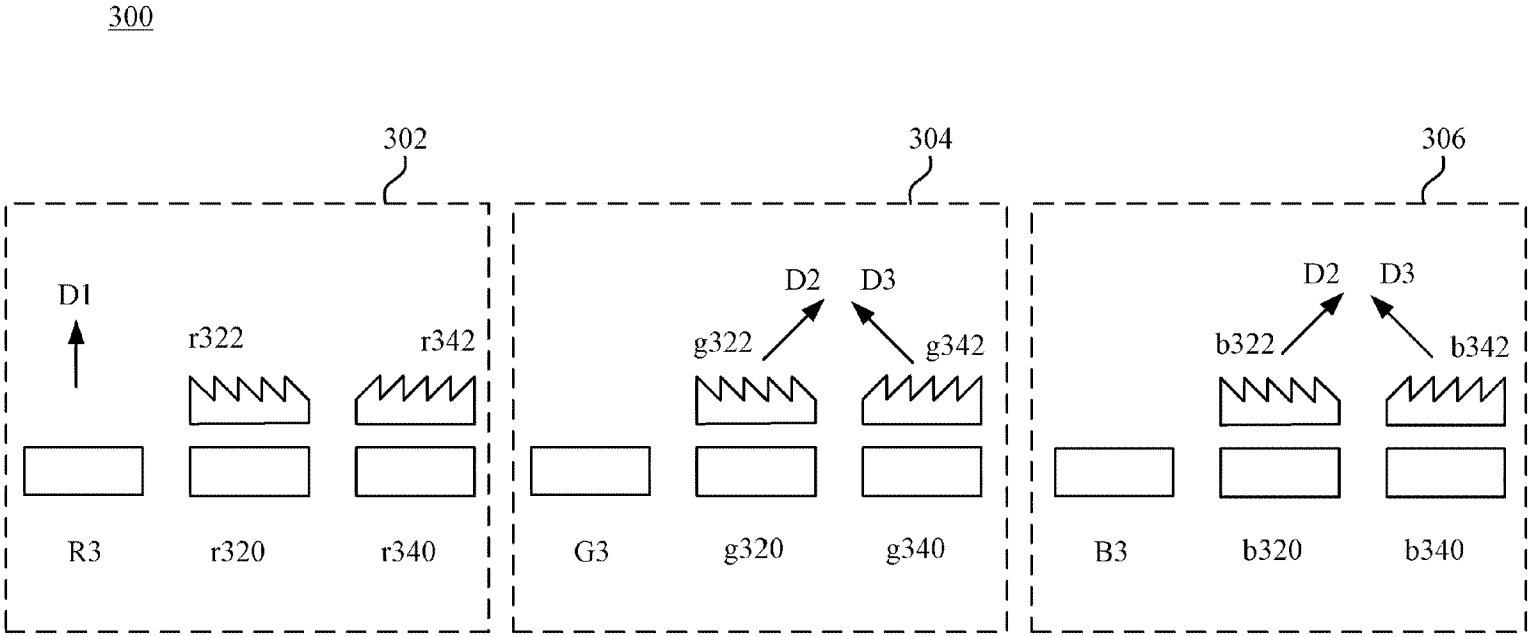
FIG. 3 is a schematic diagram of a pixel structure drawn according to some embodiments of this disclosure.

FIG. 3 is a schematic diagram of a pixel structure 300 drawn according to some embodiments of this disclosure. The pixel structure 300 of FIG. 3 is similar to the pixel structure 200 of FIG. 2. The pixel structure 300 includes a first color pixel 302, a second color pixel 304, and a third color pixel 306. The foregoing sub-pixels separately include a first-color normal-viewing sub-pixel R3, a second-color normal-viewing sub-pixel G3, and a third-color normal-viewing sub-pixel B3.

Differences between the pixel structure 300 of FIG. 3 and the pixel structure 200 of FIG. 2 are described in detail below. The first-color side-viewing sub-pixel unit r220 of FIG. 2 is divided into the first-color right-side-viewing sub-pixel unit r320 and the first-color left-side-viewing sub-pixel unit r340. The first-color side-viewing prism r222 of FIG. 2 is divided into the first-color right-side-viewing prism r322 and the first-color left-side-viewing prism r342. The second-color side-viewing sub-pixel unit g220 of FIG. 2 is divided into the second-color right-side-viewing sub-pixel unit g320 and the second-color left-side-viewing sub-pixel unit g340. The second-color side-viewing prism g222 of FIG. 2 is divided into the second-color right-side-viewing prism g322 and the second-color left-side-viewing prism g342. The third-color side-viewing sub-pixel unit b220 of FIG. 2 is divided into the third-color right-side-viewing sub-pixel unit b320 and the third-color left-side-viewing sub-pixel unit b340. The third-color side-viewing prism b222 is divided into the third-color right-side-viewing prism b322 and the third-color left-side-viewing prism b342.

In some embodiments, the side-viewing sub-pixel units of a same color are driven by a same drive transistor. For example, the first-color right-side-viewing sub-pixel unit r320 and the first-color left-side-viewing sub-pixel unit r340 are driven by a same drive transistor. The second-color right-side-viewing sub-pixel unit g320 and the second-color left-side-viewing sub-pixel unit g340 are driven by a same drive transistor. The third-color right-side-viewing sub-pixel unit b320 and the third-color left-side-viewing sub-pixel unit b340 are driven by a same drive transistor.

The second-color right-side-viewing sub-pixel unit g320 emits green light in at least the side view direction D2 by the second-color right-side-viewing prism g322. The second-color left-side-viewing sub-pixel unit g340 emits green light in at least the side view direction D3 by the second-color left-side-viewing prism g342.

The third-color right-side-viewing sub-pixel unit b320 emits blue light in at least the side view direction D2 by the third-color right-side-viewing prism b322. The third-color left-side-viewing sub-pixel unit b340 emits blue light in at least the side view direction D3 by the third-color left-side-viewing prism b342.

The remaining content of the pixel structure 300 is similar to that in the foregoing embodiment, and therefore, description is not made herein again. The pixel structure 300 can also achieve the anti-peeping objective.

Figure 4:
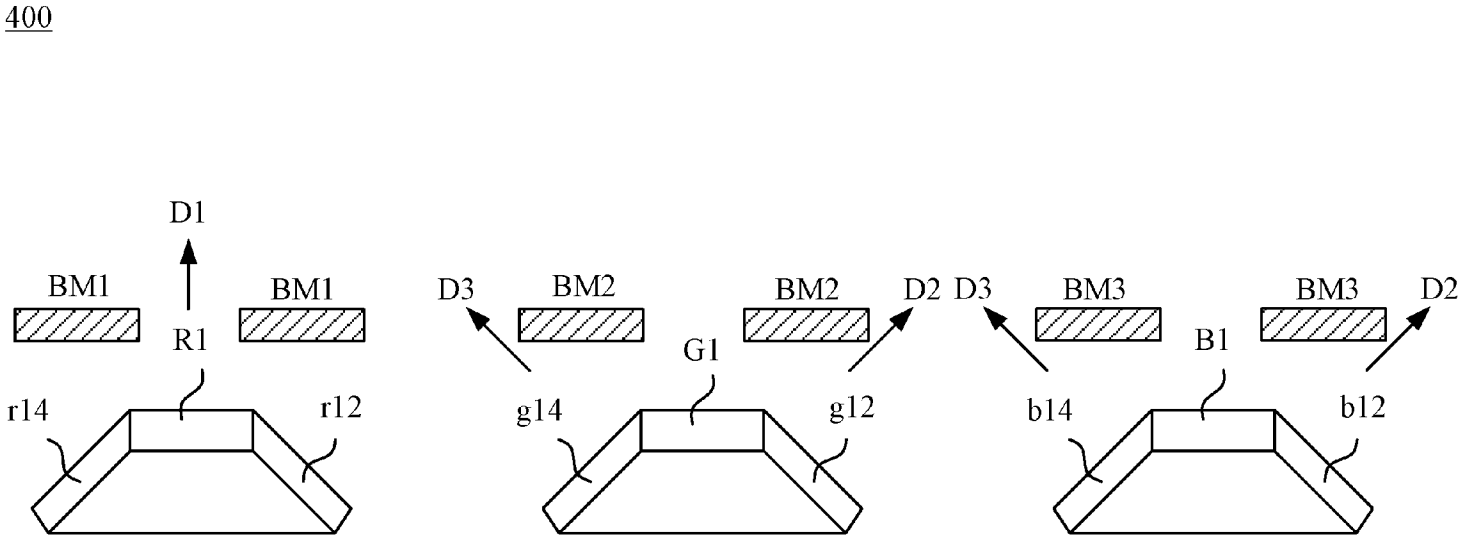
FIG. 4 is a schematic diagram of a pixel structure drawn according to some embodiments of this disclosure.

FIG. 4 is a schematic diagram of a pixel structure 400 drawn according to some embodiments of this disclosure. The pixel structure 400 of FIG. 4 is similar to the pixel structure 100 of FIG. 1A. Differences between the pixel structure 400 of FIG. 4 and the pixel structure 100 of FIG. 1A are described in detail below.

The pixel structure 400 further includes black matrix units BM1, black matrix units BM2, and black matrix units BM3. The black matrix units BM1 are disposed corresponding to the first-color normal-viewing sub-pixel R1. The black matrix units BM1 are disposed at a light emergent side of the first-color normal-viewing sub-pixel R1. The black matrix units BM1 are configured to enable red light in a normal view direction D1 to pass through the black matrix units BM1. In other words, the black matrix units BM1 are configured to block light that is emitted by the first-color normal-viewing sub-pixel R1 and is in a side view direction D2 and a side view direction D3. In this way, a user can be prevented from viewing, in the side view direction D2 or the side view direction D3, the red light emitted by the first-color normal-viewing sub-pixel R1, thereby achieving the anti-peeping objective.

The black matrix units BM2 are disposed corresponding to the second-color side-viewing sub-pixels g12 and g14. The black matrix units BM2 are disposed at light emergent sides of the second-color side-viewing sub-pixels g12 and g14. The black matrix units BM2 are configured to block light that is emitted by the second-color side-viewing sub-pixels g12 and g14 and is in the normal view direction D1. In this way, a user can be prevented from viewing, in the normal view direction D1, green light emitted by the second-color side-viewing sub-pixels g12 and g14, so as to prevent the green light from affecting the red light in the normal view direction D1, and improve display quality of the pixel structure 400.

The black matrix units BM3 are disposed corresponding to the third-color side-viewing sub-pixels b12 and b14. The black matrix units BM3 are disposed at light emergent sides of the third-color side-viewing sub-pixels b12 and b14. The black matrix units BM3 are configured to block light that is emitted by the third-color side-viewing sub-pixels b12 and b14 and is in the normal view direction D1. In this way, a user can be prevented from viewing, in the normal view direction D1, blue light emitted by the third-color side-viewing sub-pixel b12 and b14, so as to prevent the blue light from affecting the red light in the normal view direction D1, and improve display quality of the pixel structure 400.

Figure 5:
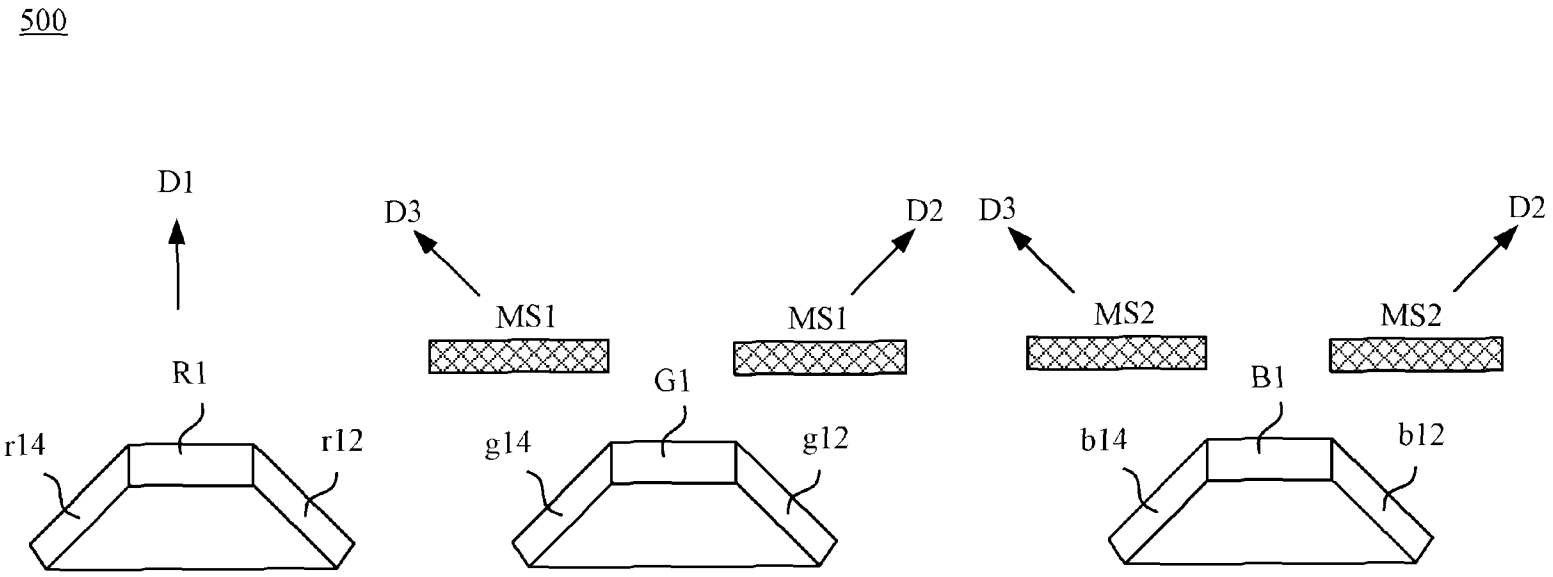
FIG. 5 is a schematic diagram of a pixel structure drawn according to some embodiments of this disclosure.

FIG. 5 is a schematic diagram of a pixel structure 500 drawn according to some embodiments of this disclosure. The pixel structure 500 of FIG. 5 is similar to the pixel structure 100 of FIG. 1A. Differences between the pixel structure 500 of FIG. 5 and the pixel structure 100 of FIG. 1A are described in detail below.

The pixel structure 500 further includes microstructure units MS1 and microstructure units MS2. In some embodiments, the microstructure units MS1 and the microstructure units MS2 are implemented by prisms with light-converging structures. However, this disclosure is not limited thereto.

The microstructure units MS1 are disposed corresponding to the second-color side-viewing sub-pixels g12 and g14. The light emitted by the second-color side-viewing sub-pixels g12 and g14 is in Lambertian distribution, and therefore, the side view direction D2 and the side view direction D3 are not the only two directions in which the light emitted by the second-color side-viewing sub-pixels g12 and g14 appears. That is, a part of light may appear in the normal view direction D1. The microstructure units MS1 are configured to reduce light that is emitted by the second-color side-viewing sub-pixels g12 and g14 and is in the normal view direction D1.

In other words, the microstructure units MS1 are configured to concentrate light field distribution of light emitted by the second-color side-viewing sub-pixels g12 and g14. For example, after passing through the corresponding microstructure unit MS1, green light emitted by the second-color side-viewing sub-pixel g12 is emitted towards the side view direction D2 in a more concentrated manner, and after passing through the corresponding microstructure unit MS1, green light emitted by the second-color side-viewing sub-pixel g14 is emitted towards the side view direction D3 in a more concentrated manner. In this way, a user can be prevented from viewing, in the normal view direction D1, the green light emitted by the second-color side-viewing sub-pixels g12 and g14, so as to prevent the green light from affecting the red light in the normal view direction D1, and improve display quality of the pixel structure 500.

The microstructure units MS2 are disposed corresponding to the third-color side-viewing viewing sub-pixels b12 and b14. The light emitted by the third-color side-viewing sub-pixels b12 and b14 is in Lambertian distribution, and therefore, the side view direction D2 and the side view direction D3 are not the only two directions in which the light emitted by the third-color side-viewing sub-pixels b12 and b14 appears. That is, a part of light may appear in the normal view direction D1. The microstructure units MS2 are configured to reduce light that is emitted by the third-color side-viewing sub-pixels b12 and b14 and is in the normal view direction D1.

In other words, the microstructure units MS2 are configured to concentrate light field distribution of light emitted by the third-color side-viewing sub-pixels b12 and b14. For example, after passing through the corresponding microstructure unit MS2, blue light emitted by the third-color side-viewing sub-pixel b12 is emitted towards the side view direction D2 in a more concentrated manner, and after passing through the corresponding microstructure unit MS2, blue light emitted by the third-color side-viewing sub-pixel b14 is emitted towards the side view direction D3 in a more concentrated manner. In this way, a user can be prevented from viewing, in the normal view direction D1, blue light emitted by the third-color side-viewing sub-pixels b12 and b14, so as to prevent the blue light from affecting the red light in the normal view direction D1, and improve display quality of the pixel structure 500.

Figure 6:
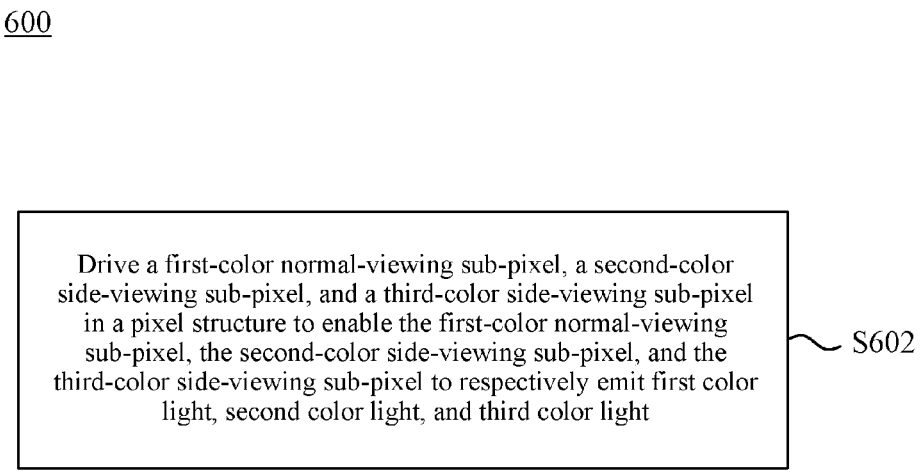
FIG. 6 is a flowchart of a step of a display method drawn according to some embodiments of this disclosure.

FIG. 6 is a flowchart of a step of a display method 600 drawn according to some embodiments of this disclosure. The display method 600 is described below by using the pixel structure 100, but this disclosure is not limited thereto.

In step S602, the first-color normal-viewing sub-pixel R1, the second-color right-side-viewing sub-pixel g12, and the third-color right-side-viewing sub-pixel b12 in the pixel structure 100 are driven, so as to enable the first-color normal-viewing sub-pixel R1, the second-color right-side-viewing sub-pixel g12, and the third-color right-side-viewing sub-pixel b12 to separately emit the first color light, the second color light, and the third color light. Using FIG. 1A and FIG. 1B as an example, the first color light, the second color light, and the third color light are separately red light, green light, and blue light. The red light emitted from the first-color normal-viewing sub-pixel R1, the green light emitted from the second-color right-side-viewing sub-pixel g12, and the blue light emitted from the third-color right-side-viewing sub-pixel b12 are mixed to obtain a white emission in the side view direction D2. In some embodiments, the side viewing angle A2 between the side view direction D2 and the normal view direction D1 is between 10° and 80°.

In other embodiments, using FIG. 3 as an example, the second-color right-side-viewing sub-pixel unit g320 and the second-color left-side-viewing sub-pixel unit g340 are driven synchronously, and the third-color right-side-viewing sub-pixel unit b320 and the third-color right-side-viewing sub-pixel unit b340 are driven synchronously, such that the red light that is emitted by the first-color normal-viewing sub-pixel R3 and is in the side view direction D2 and the side view direction D3 is to be mixed to obtain a white emission.

To sum up, by using one of the aforementioned embodiments, an anti-peeping capability of a display device can be improved.

Although description of this disclosure is made as above by using implementation manners, the description is not intended to limit this disclosure. A person skilled in the art can make various variations and modifications without departing from the spirit and scope of this disclosure. Therefore, the protection scope of this disclosure shall be construed as limited by the appended claims.

What is claimed is:

1. A pixel structure, comprising:

a first color pixel, comprising a first-color normal-viewing sub-pixel and at least one first-color side-viewing sub-pixel;

a second color pixel, comprising a second-color normal-viewing sub-pixel and at least one second-color side-viewing sub-pixel; and a third color pixel, comprising a third-color normal-viewing sub-pixel and at least one third-color side-viewing sub-pixel, wherein each of the first-color normal-viewing sub-pixel, the second-color normal-viewing sub-pixel, the third-color normal-viewing sub-pixel, the first-color side-viewing sub-pixel, the second-color side-viewing sub-pixel and the third-color side-viewing sub-pixel is configured to emit light, such that the light emitted by each of the first-color normal-viewing sub-pixel, the second-color normal-viewing sub-pixel and the third-color normal-viewing sub-pixel has an intensity in a normal view direction greater than an intensity in each of at least one side view direction, and the light emitted by each of the first-color side-viewing sub-pixel, the second-color side-viewing sub-pixel and the third-color side-viewing sub-pixel has an intensity in each of the at least one side view direction greater than an intensity in the normal view direction;

wherein the at least one side view direction comprises a first side view direction; and wherein when the first-color normal-viewing sub-pixel is driven to emit a first color light to obtain a first color emission in the normal view direction, the second-color side-viewing sub-pixel is driven to correspondingly emit a second color light and the third-color side-viewing sub-pixel is driven to correspondingly emit a third color light, such that the first color light emitted from the first-color normal-viewing sub-pixel, the second color light emitted from the second-color side-viewing sub-pixel, and the third color light emitted from the third-color side-viewing sub-pixel are mixed to obtain a white emission in the first side view direction.

2. The pixel structure according to claim 1, wherein a side viewing angle is formed between the first side view direction and the normal view direction of the first-color normal-viewing sub-pixel, and the side viewing angle is within a range between 10° and 80°.

3. The pixel structure according to claim 1, wherein the at least one side view direction further comprises a second side view direction, the at least one second-color side-viewing sub-pixel comprises a second-color side-viewing sub-pixel structure and a second-color side-viewing prism; the second-color side-viewing sub-pixel structure emits the second color light in the first side view direction and the second side view direction by the second-color side-viewing prism; the at least one third-color side-viewing sub-pixel comprises a third-color side-viewing sub-pixel structure and a third-color side-viewing prism; and the third-color side-viewing sub-pixel structure emits the third color light in the first side view direction and the second side view direction by the third-color side-viewing prism.

4. The pixel structure according to claim 1, wherein the at least one side view direction further comprises a second side view direction, the at least one second-color side-viewing sub-pixel comprises a second-color left-side-viewing sub-pixel structure, a second-color right-side-viewing sub-pixel structure, a second-color left-side-viewing prism, and a second-color right-side-viewing prism; the second-color right-side-viewing sub-pixel structure emits the second color light in the first side view direction by the second-color right-side-viewing prism; and the second-color left-side-viewing sub-pixel structure emits the second color light in the second side view direction by the second-color left-side-viewing prism.

5. The pixel structure according to claim 4, wherein the at least one third-color side-viewing sub-pixel comprises a third-color left-side-viewing sub-pixel structure, a third-color right-side-viewing sub-pixel structure, a third-color left-side-viewing prism, and a third-color right-side-viewing prism; the third-color right-side-viewing sub-pixel structure emits the third color light in the first side view direction by the third-color right-side-viewing prism; and the third-color left-side-viewing sub-pixel structure emits the third color light in the second side view direction by the third-color left-side-viewing prism.

6. The pixel structure according to claim 1, further comprising:

a first black matrix, disposed corresponding to the first-color normal-viewing sub-pixel and configured to block the light in the first side view direction of the first-color normal-viewing sub-pixel;

a second black matrix, disposed corresponding to the at least one second-color side-viewing sub-pixel and configured to block the light in the normal view direction of the at least one second-color side-viewing sub-pixel; and a third black matrix, disposed corresponding to the at least one third-color side-viewing sub-pixel and configured to block the light in the normal view direction of the at least one third-color side-viewing sub-pixel.

7. The pixel structure according to claim 1, further comprising:

a first microstructure, disposed corresponding to the at least one second-color side-viewing sub-pixel and configured to reduce light in the normal view direction of the at least one second-color side-viewing sub-pixel; and a second microstructure, disposed corresponding to the at least one third-color side-viewing sub-pixel and configured to reduce light in the normal view direction of the at least one third-color side-viewing sub-pixel.

8. The pixel structure according to claim 1, wherein the first color pixel, the second color pixel, and the third color pixel comprise organic light emitting diodes (OLEDs).

9. The pixel structure according to claim 1, wherein a first-color right-side-viewing sub-pixel and a first-color left-side-viewing sub-pixel are separately disposed at two sides of the first-color normal-viewing sub-pixel, and separately have a first oblique angle and a second oblique angle with the first-color normal-viewing sub-pixel.

10. A display method, comprising:

providing the pixel structure according to claim 1;

driving the first-color normal-viewing sub-pixel, the at least one second-color side-viewing sub-pixel, and the at least one third-color side-viewing sub-pixel in the pixel structure to enable the first-color normal-viewing sub-pixel, the at least one second-color side-viewing sub-pixel, and the at least one third-color side-viewing sub-pixel to respectively emit the first color light, the second color light, and the third color light, wherein the first color light is emitted to obtain the first color emission in the normal view direction, and the first color light, the second color light, and the third color light are mixed to obtain the white emission in the first side view direction.

11. The display method according to claim 10, wherein the driving the at least one second-color side-viewing sub-pixel and the driving the at least one third-color side-viewing sub-pixel comprise:

driving a second-color left-side-viewing sub-pixel structure and a second-color right-side-viewing sub-pixel structure; and driving a third-color left-side-viewing sub-pixel structure and a third-color right-side-viewing sub-pixel structure.

12. A pixel structure, comprising:

a first color pixel, comprising a first-color normal-viewing sub-pixel and at least one first-color side-viewing sub-pixel;

a second color pixel, comprising a second-color normal-viewing sub-pixel and at least one second-color side-viewing sub-pixel; and a third color pixel, comprising a third-color normal-viewing sub-pixel and at least one third-color side-viewing sub-pixel, wherein a plurality of oblique angles are formed between the first-color normal-viewing sub-pixel and each of the at least one first-color side-viewing sub-pixel, between the second-color normal-viewing sub-pixel and each of the at least one second-color side-viewing sub-pixel, and between the third-color normal-viewing sub-pixel and each of the at least one third-color side-viewing sub-pixel, respectively;

wherein first color light emitted from the first-color normal-viewing sub-pixel, second color light emitted from the second-color side-viewing sub-pixel, and third color light emitted from the third-color side-viewing sub-pixel are mixed to obtain a white emission in a first side view direction.

13. The pixel structure according to claim 12, wherein the at least one second-color side-viewing sub-pixel comprises a second-color left-side-viewing sub-pixel and a second-color right-side-viewing sub-pixel, wherein the second-color left-side-viewing sub-pixel and the second-color normal-viewing sub-pixel form a first oblique angle, the second-color right-side-viewing sub-pixel and the second-color normal-viewing sub-pixel form a second oblique angle, and the second-color left-side-viewing sub-pixel and the second-color right-side-viewing sub-pixel are not parallel to each other.

* * * * *